US006654576B2

(12) United States Patent
Dougherty

(10) Patent No.: US 6,654,576 B2
(45) Date of Patent: Nov. 25, 2003

(54) SYSTEM FOR AND METHOD OF REDUCING TONER SEAL LEAKAGE BY THE INTRODUCTION OF A STEP GROOVE IN THE DEVELOPER ROLLER

(75) Inventor: Patrick Dougherty, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/103,209

(22) Filed: Mar. 21, 2002

(65) Prior Publication Data

US 2003/0180067 A1 Sep. 25, 2003

(51) Int. Cl.[7] ..... G03G 15/08
(52) U.S. Cl. ..... 399/103
(58) Field of Search ..... 399/102, 103, 399/105, 106, 279

(56) References Cited

U.S. PATENT DOCUMENTS 4,992,767 A * 2/1991 Hozumi et al. ..... 399/279 X
5,369,477 A * 11/1994 Foote et al. ..... 399/102
5,757,395 A 5/1998 Chew et al. ..... 347/24
5,760,817 A 6/1998 Foote et al. ..... 347/248
5,854,961 A 12/1998 Wibbels et al. ..... 399/281
5,983,053 A * 11/1999 Mordenga et al. ..... 399/103
6,185,393 B1 * 2/2001 Karakama et al. ..... 399/103

FOREIGN PATENT DOCUMENTS

JP 62-208073 * 9/1987
JP 63-106766 * 5/1988

OTHER PUBLICATIONS

"Oasis– Tech's Tool Box– Laser Printing Process" [on–line] [Retrieved on Nov. 26, 2001]Retrieved from: http://www.oasis–imaging.com/tech/related.html, pp. 1–4.
"The PC Technology Guide– Laser Printers" [on–line] [Retrieved on Nov. 26, 2001] Retrieved from: http:// www-.pctechguide.com/12lasers.htm, pp. 1–8.

* cited by examiner

*Primary Examiner*—Fred L Braun

(57) ABSTRACT

The present invention is directed to a sealing mechanism and method for reducing toner seal leakage for use in a toner cartridge which includes a developer roller having an outer roller diameter and an annular groove in the develope, roller, the groove having an outer groove diameter that is smaller than the outer roller diameter. A flexible seal has an inner seal diameter adapted to engage the annular groove and an outer seal diameter. The inner seal diameter interfaces with the outer groove diameter and the outer seal diameter is greater than the outer roller diameter.

20 Claims, 2 Drawing Sheets

SYSTEM FOR AND METHOD OF REDUCING TONER SEAL LEAKAGE BY THE INTRODUCTION OF A STEP GROOVE IN THE DEVELOPER ROLLER

RELATED APPLICATIONS

The present application is related to commonly assigned U.S. patent application Ser. No. 10/103,208 entitled "METHOD OF AND SYSTEM FOR THE REDUCTION OF TONER PRESSURE APPLIED TO A PRINT SEAL THROUGH THE IMPLEMENTATION OF A TAPERING CHANNEL" filed concurrently with this application; U.S. patent application Ser. No. 10/103,430 entitled "SYSTEM FOR AND METHOD OF PREVENTING TONER LEAKAGE PAST DEVELOPER SEALS USING STATIC CHARGE" filed concurrently with this application; U.S. patent application Ser. No. 10/103,371 entitled "SYSTEM FOR AND METHOD OF REDUCING OR ELIMINATING TONER LEAKAGE WITH A VIBRATING SEAL" filed concurrently with this application; and U.S. patent application Ser. No. 10/103,451 entitled "SYSTEM FOR AND METHOD OF TONER FLOW CONTROL" filed concurrently with this application, the disclosures of which are hereby incorporated herein by reference in their entirety.

TECHNICAL FIELD

The present invention is related generally to toner cartridges for imaging devices and, more particularly, to the reduction or elimination of toner leakage from such devices.

BACKGROUND

Currently there are several types of technologies used in printing and copying systems. Electrophotographic printing devices, such as laser printers and copiers, use toner particles to form the desired image on the print medium, which is usually some type of paper. Once the toner is applied to the paper, the paper is advanced along the paper path to a fuser. In many printers, copiers and other electrophotographic printing devices, the fuser includes a heated fusing roller that is engaged by a mating pressure roller. As the paper passes between the rollers, toner is fused to the paper through a process of heat and pressure.

FIG. 1 is a diagram of typical laser printing device 100 employing an Electrophotography (EP) process. For monochromatic printing, a single color of toner particles 101 is held in toner supply hopper 102. Toner particles 101 are typically small plastic (e.g., styrene) particles on the order of 5 microns ($10^{-6}$ meter) in size. Agitator (or stirring blade) 103 is typically made of plastic such as mylar and ensures toner particles 101 are uniformly positioned along developer sleeve 104 while inducing a negative charge onto the toner particles in the range of −30 to −80 micro coulomb per gram ($\mu c/g$). Developer sleeve 104 rotates in a counterclockwise direction about an internal stationary magnet 105 acting as a shaft. Toner particles 101 are attracted to the rotating developer sleeve 104 by the magnetic forces of stationary magnet 105. Doctor blade 106 charges the toner and metes out a precise and uniform amount of toner particles 101 onto developer sleeve 104 as its outer surface rotates external to toner supply hopper 102. Developer sealing blade 107 removes excess toner particles 101 affixed to developer sleeve 104 as its outer surface rotates back into toner supply hopper 102. Developer sealing blade 107 removes excess toner particles 101 affixed to developer sleeve 104 as its outer surface rotates back into toner supply hopper 102 and prevents toner particles 101 from falling out of toner supply hopper 102 onto paper, along the length of developer sleeve 104.

Primary Charging Roller (PCR) 108 conditions Organic Photo Conductor (OPC) drum 109 using a constant flow of current to produce a blanket of uniform negative charge on the surface of OPC drum 109. Production of the uniform charge by PCR 108 also has the effect of erasing residual charges left from any previous printing or transfer cycle.

A critical component of the EP process is OPC drum 109. OPC drum 109 is a thin-walled aluminum cylinder coated with a photoconductive layer. The photoconductive layer may constitute a photodiode that accepts and holds a charge from PCR 108. Initially, the unexposed surface potential of the OPC is charged to approximately −600 volts. Typically, the photoconductive layer comprises three layers including, from the outermost inward, a Charge Transport Layer (CTL), Charge Generation Layer (CGL), and barrier or oxidizing layer formed on the underlying aluminum substrate. The CTL is a clear layer approximately 20 microns thick, which allows light to pass through to the CGL and controls charge acceptance to the OPC. The CGL is about 0.1 to 1 micron thick and allows the flow of ions. The barrier layer bonds the photoconductive layer to the underlying aluminum substrate.

Scanning laser beam 110 exposes OPC drum 109 one line at a time at the precise locations that are to receive toner (paper locations which correspond to dark areas of the image being printed). OPC drum 109 is discharged from −600V to approximately −100V at points of exposure to laser beam 110, creating a relatively positively charged latent image on its surface. Transformation of the latent image into a developed image begins when toner particles 101 are magnetically attracted to rotating developer sleeve 104. Alternatively, if a nonmagnetic toner is used, developer sleeve 104 may comprise a developer roller to mechanically capture and transport toner particles 101. In this case, an open cell foam roller may be included to apply toner to developer sleeve 104. The still negatively charged toner particles held by developer sleeve 104 are attracted to the relatively positively charged areas of the surface of OPC drum 109 and "jump" across a small gap to the relatively positively charged latent image on OPC drum 109 creating a "developed" image on the drum.

Paper to receive toner from OPC drum 109 is transported along paper path 111 between OPC drum 109 and transfer roller 112, with the developed image transferred from the surface of OPC drum 109 to the paper. The transfer occurs by action of transfer roller 112 which applies a positive charge to the underside of the paper, attracting the negatively-charged toner particles and causing them to move onto the paper. Wiper blade 113 cleans the surface of the OPC drum 109 by scraping off the waste (untransferred) toner into waste hopper 115, while recovery blade 114 prevents the waste toner from falling back onto the paper. Fusing occurs as the paper, including toner particles, is passed through a nip region between heated roller 116 and pressure roller 117 where the toner is melted and fused (or "bonded") to the paper. Heated roller 116 and pressure roller 117 are together referred to as the fuser assembly.

One design consideration with EP imaging devices, such as laser printers, is to minimize the leakage of toner from the hopper. Leakage sometimes occurs at the ends of developer sleeve 104. Several methodologies and arrangements have been used to reduce or eliminate toner leakage from the ends of developer sleeve 104. Some printers employ a foam or felt mechanical seal at the ends of developer sleeve 104 as a physical barrier to prevent toner particles from slipping past the interface between developer sleeve 104 and toner supply hopper 102. Alternatively, when the toner includes magnetic properties, such as in many black and white printers, magnetic seals may be provided at the ends of developer sleeve 104 to tract monochromatic toner particles and create a physical barrier, consisting of the monochromatic toner particles, to prevent additional particles from leaking. Unfortunately such techniques are generally inapplicable to the non-magnetic type of toner used, for example, in most color printers and copiers.

FIG. 2 shows developer roller 201 with conventional prior art seal 202 in place to reduce toner leakage. Seal 202 rides along an outer surface of developer roller 201. However, toner fluid pressure may be sufficient to cause toner particles to seep under seal 202 and out the end of the roller assembly.

Accordingly, a need exists for a structure and method for reducing toner leakage in a torner cartridge.

SUMMARY OF THE INVENTION

The present invention is directed to a sealing mechanism for use in a toner cartridge comprising a developer roller with an annular groove. In one embodiment of the invention, the annular groove intrudes into the surface, a bottom of the groove having a diameter smaller than a diameter of the outer roller. A flexible end seal has a stepped profile, a central portion extending into and engaging the annular groove and peripheral outer portion in contact with an outer surface of the roller.

DETAILED DESCRIPTION

The present invention includes annular stepped grooves formed near the ends of a developer roller to engage a pair of flexible seals thereby creating a barrier to toner leakage. This barrier helps keep the toner behind the seal as opposed to spilling out into the machine or onto the page.

Figure 1:
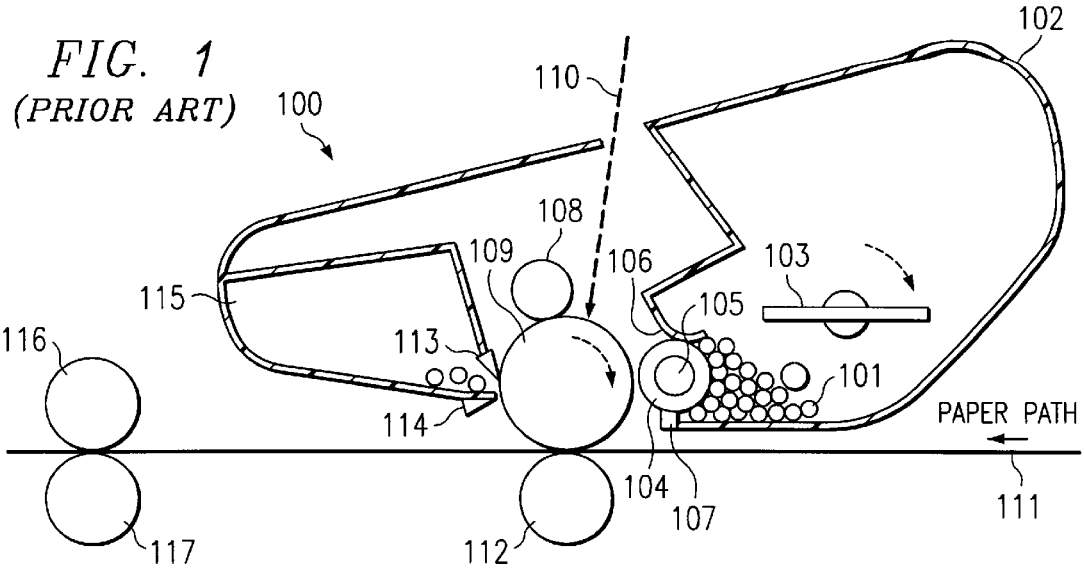
FIG. 1 (PRIOR ART)
FIG. 1 shows a side view of a simplified cartridge cross-section.
Figure 2:
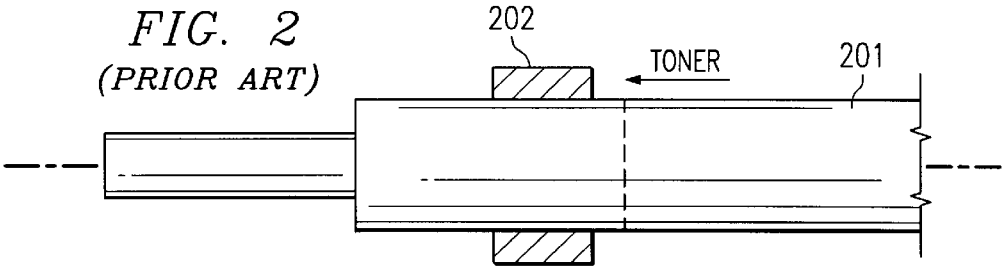
FIG. 2 (PRIOR ART)
FIG. 2 shows a prior art developer roller.
Figure 3:
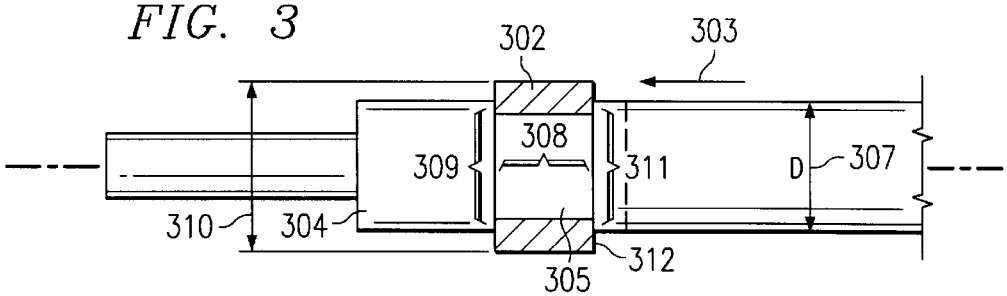
FIG. 3 is a partial cross-sectional view of a developer roller with an annular end groove and mating with a flexible seal.

FIG. 3 is a partial cross-sectional view of a developer roller and seal according to one embodiment of the current invention. In this embodiment, developer roller 304 has a main outer surface of diameter 307, and a stepped annular groove 305. The developer roller includes a substantially uniform cylindrical outer surface operative for applying a uniform thickness of toner onto discharged portions of an adjacent OPC drum (not shown). The developer roller is also supported by roller supports. Annular groove 305 has a diameter 311 that is smaller than the outer roller diameter 307, resulting in a depth of between 1 and 2 mm measured from the upper surface of the roller to the bottom of the groove. Annular groove 305 also has a width 308 within a range of 2 to 5 mm.

In one embodiment of the present invention, a flexible seal 302 is positioned within annular groove 305. Flexible seal 302 may be formed as an extension of the normal seal portion extending around the back of developer roller 304 with reference to the present view. As depicted, flexible seal 302 has an inside seal diameter 309 and an outside seal diameter 310. The inner seal diameter 309 is slightly larger than diameter 311. A snug fit is desirable between flexible seal 302 and developer roller 304 to prevent or reduce the amount of toner passing between flexible seal 302 and developer roller 304. Note that toner particles make contact with inner wall 312 of flexible seal 302. Flexible seal 302 mates with the annular groove 305 portion of developer roller 304 to prevent or reduce toner 303 from leaking.

In addition to reducing or eliminating toner leakage, the groove/seal combination also reduces the pressure from the toner present on the seal, provides lateral support for the seal to resist toner fluid pressure, and increases the total contact area between flexible seal 302 and developer roller 304. The annular groove also reduces the area of the seal that the toner comes in contact with. The lower pressure on the seal results in less stress on developer roller 304 thereby improving the life span of developer roller 304. Flexible seal 302 may be composed of a foam made of cellular eurathane for example, PORON® by Rogers Corporation. Note that toner particles make contact with inner wall 312 of flexible seal 302.

Figure 4:
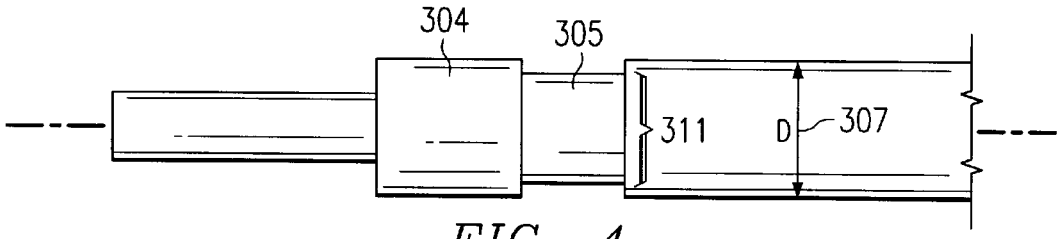
FIG. 4 is a partial cross-sectional view showing detail of the stepped annular end groove formed in a developer roller according to the present invention.

FIG. 4 is a front sectional view of developer roller 304 alone. As previously described, groove diameter 311 is smaller than outer roller diameter 307. The positioning of a portion of flexible seal 302 (FIG. 3) below the normal surface of the developer roller into the annular groove reduces toner leakage. Outer seal diameter 310 (FIG. 3) may be within 1 to ten millimeters of outer roller diameter 307. Outer groove diameter 311 may be between 1 and 4 millimeters of outer roller diameter 307. Inner seal diameter 309 (FIG. 3) may be between 1 and 4 millimeters of outer roller diameter 307. Note that other dimensions may be used.

Figure 6:
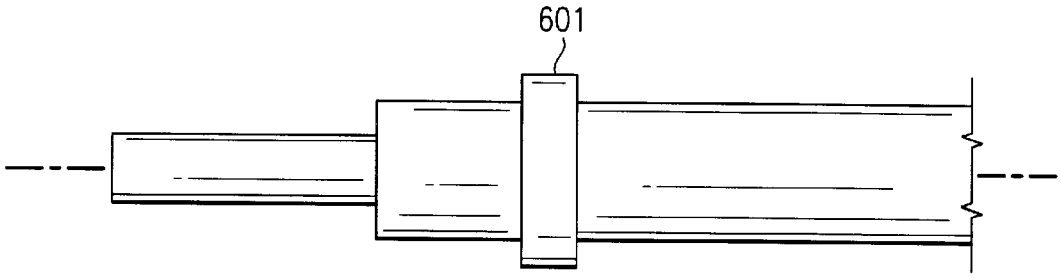
FIG. 6 is a partial cross-sectional view detail of an alternate embodiment of the present invention.

Although only a single annular groove and mating seal configuration are shown, it is preferable that such a seal mechanism be included at both ends of the developer roller. Further, while a single groove is shown, multiple grooves may be formed adjacent one another to further increase seal to roller contact area and reduce leakage. Additionally, rather than form grooves into the surface of the roller, annular ridges 601 of FIG. 6 may be formed extending above the surface of the developer roller, or some combination of grooves and ridges may be used together with corresponding mating seal structures.

Figure 5:
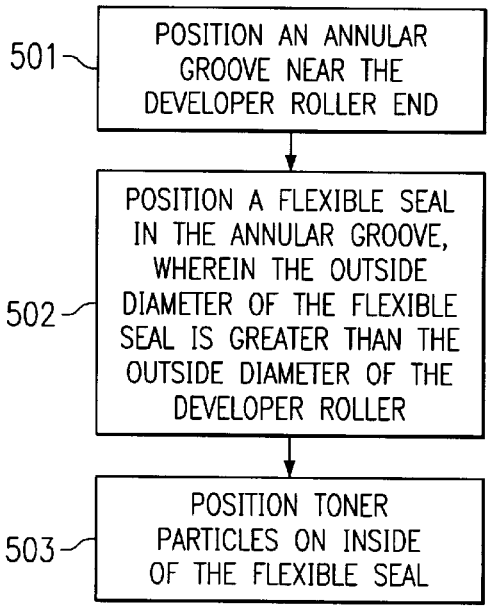
FIG. 5 is a block diagram of a method of the present invention to reduce toner leakage.

FIG. 5 is a flow diagram of one embodiment of a method of the present invention. In step 501, an annular groove is positioned near the end of a developer roller. The positioning of this annular groove may be outside the normal print area of the imaging system. In step 502, a flexible seal is positioned within the annular groove. The inside diameter of the flexible seal should be only slightly larger than the diameter of the annular groove of the developer roller. Additionally, the outside diameter of the flexible seal should be greater than the outside diameter of the developer roller. In step 503, toner is placed within a toner hopper of the imaging device such that toner contacts the inside portion or inside wall of flexible seal, that is the portion of the flexible seal that is contained within the toner hopper.

What is claimed is:

1. A sealing mechanism for use in a toner cartridge, comprising a developer roller having an outer roller diameter, said developer roller having at least one annular groove formed in an outer surface of said developer roller, said groove having an outer groove diameter wherein said outer groove diameter is smaller than said outer roller diameter; and at least one flexible seal having an inner surface engaged to said annular groove, and an outer seal diameter, wherein said inner surface interfaces with said outer groove diameter and said outer seal diameter is greater than said outer roller diameter.

2. The sealing mechanism of claim 1 wherein said annular groove is proximate to a first end of said developer roller.

3. The sealing mechanism of claim 2 further comprising:

at least one annular groove located proximate to a second end of said developer roller.

4. The sealing mechanism of claim 1 wherein said flexible seal is composed of a foam made of cellular eurathane.

5. The sealing mechanism of claim 1 further comprising:

a roller support wherein said flexible seal is attached to said roller support.

6. The sealing mechanism of claim 1 wherein said outer seal diameter is within 1 to ten millimeters of the outer roller diameter.

7. The sealing mechanism of claim 1 wherein said outer groove diameter is within 1 to 4 millimeters of the outer roller diameter.

8. The sealing mechanism of claim 1 wherein said outer groove diameter is within 1 to 4 millimeters of said outer roller diameter and said inner seal diameter is within 1 to 4 millimeters of outer roller diameter.

9. A method of reducing toner leakage in a toner cartridge, said method comprising:

engaging an inner seal diameter of a first flexible seal within a first annular groove formed in a developer roller;

applying toner to said developer roller in a vicinity of said first flexible seal;

whereby an outer seal diameter of said first flexible seal has a greater diameter than an outer diameter of said developer roller and said toner is blocked from moving past a inside wall of said first flexible seal.

10. The method of claim 9 further comprising the step of:

locating said annular groove proximate to the end of said developer roller.

11. The method of claim 9 further comprising the step of:

engaging an inner seal diameter of a second flexible seal within a second annular groove formed in said developer roller;

whereby an outer seal diameter of said second flexible seal has a greater diameter than an outer diameter of said developer roller and said toner is blocked from moving past a inside wall of said second flexible seal.

12. The method of claim 9 further comprising a step of:

engaging said first flexible seal to said developer roller.

13. The method of claim 11, further comprising a step of:

capturing residual toner between said inside wall of said first flexible seal and said inside wall of said second flexible seal.

14. A toner cartridge, comprising:

a housing;

a development unit including a toner supply hopper and a development roller having a cylindrical exterior surface with a pair of annular grooves formed in said surface at opposite ends of said developer roller;

a cleaning unit including a waste hopper, a wiper blade, a cleaning blade and a blow-out blade;

a primary charge roller;

a transfer roller;

an organic photo conductor; and a pair of flexible seals each having an inside seal diameter and an outside seal diameter wherein said inside seal diameter engages with a groove diameter of said developer roller and wherein said outside seal diameter is greater than an outside diameter of said developer roller.

15. The toner cartridge of claim 14 wherein said annular grooves are proximate to the end of said developer roller.

16. The toner cartridge of claim 14 wherein said flexible seals are composed of a foam made of cellular eurathane.

17. The toner cartridge of claim 14 further comprising:

a roller support wherein said flexible seals are attached to said roller support.

18. The toner cartridge of claim 14 wherein said outer seal diameter is within a range of 1 to ten millimeters of the outer roller diameter.

19. The toner cartridge of claim 14 wherein said outer groove diameter is within a range of 1 to 4 millimeters of the outer roller diameter.

20. The toner cartridge of claim 14 wherein said outer groove diameter is within a range of 1 to 4 millimeters of said outer roller diameter and said inner seal diameter is within a range of 1 to 4 millimeters of outer roller diameter.

* * * * *